United States Patent [19]

Jourde et al.

[11] Patent Number: 4,907,949

[45] Date of Patent: Mar. 13, 1990

[54] VARIABLE FLOW PUMP

[75] Inventors: Jean-Pierre Jourde, Croissy sur Seine; Marc Miettaux, Decines, both of France

[73] Assignee: Regie Nationale des Usines Renault, Boulogne-Billancourt, France

[21] Appl. No.: 259,452

[22] Filed: Oct. 17, 1988

Related U.S. Application Data

[63] Continuation of Ser. No. 942,374, Dec. 16, 1986, abandoned.

[51] Int. Cl.[4] ..... F04B 1/00

[52] U.S. Cl. ..... 417/252; 417/295

[58] Field of Search ..... 417/251, 252, 505, 510, 417/295, 493; 123/458

[56] References Cited

U.S. PATENT DOCUMENTS

| | | | |
|---|---|---|---|
| 1,948,047 | 2/1934 | Retel | 417/252 X |
| 2,653,543 | 9/1953 | Mott | 417/304 X |
| 2,841,085 | 7/1958 | Evans | 417/251 |
| 3,059,579 | 10/1962 | Bessiere | 417/251 |
| 3,709,639 | 1/1973 | Suda et al. | 417/493 |
| 4,208,871 | 6/1980 | Riple, Jr. | 417/252 |
| 4,282,843 | 8/1981 | Seilly et al. | 417/253 X |

FOREIGN PATENT DOCUMENTS

| | | | |
|---|---|---|---|
| 2107371 | 9/1971 | Fed. Rep. of Germany | 417/505 |

*Primary Examiner*—Leonard E. Smith

*Attorney, Agent, or Firm*—Oblon, Spivak, McClelland, Maier & Neustadt

[57] ABSTRACT

Variable flow pump comprising at least a piston (1) associated with a chamber (2), said piston (1) cooperating with a surface (3) driven in a constant displacement reciprocating movement, characterized in that the piston (1) is free of any continuous mechanical connection with said surface (3); and wherein said chamber (2) is associated with a flow regulating system (9) placed upstream, and wherein it is equipped with a clack valve (7) on the feed and with a clack valve (8) on the delivery; said regulating system (9) being fed by a booster pump (10).

4 Claims, 4 Drawing Sheets

VARIABLE FLOW PUMP

This application is a continuation of application Ser. No. 942,374, filed on Dec. 16, 1986, now abandoned.

This invention relates to a flow generation system of the variable flow pump type, which applies particularly to the feeding of fuel to engines.

High pressure variable flow generation devices generally use piston pumps. In these types of pump, the stroke of the piston can be made to vary mechanically.

Because of the pressures brought into play, and the precision required in the mechanical unit, these known devices exhibit the drawback of having a very great complexity. Moreover, the forces used in this unit necessitate a machining of very great precision of all the components. Moreover, these devices are difficult to adapt to an electric control, because there are always interface problems. Therefore, most of the time electro-hydraulic systems are needed which are great consumers of energy, which gives a very poor efficiency.

The object of this invention is to propose a flow generation system of the high-efficiency, variable flow pump type which is free of any continuous mechanical connection with the power take-off.

For this purpose, the invention has as its object a variable flow pump which has at least a piston associated with a chamber; said piston cooperating with a surface driven in a constant displacement reciprocating movement. The piston is free of any continuous mechanical connection with said surface. The chamber is associated with a flow regulating system which is placed upstream from this chamber. In addition, the chamber is equipped with a clack valve on its feed, and it is equipped with a clack valve on its delivery. The regulating system is fed by a booster pump.

It is made so that the chamber is directly constituted by the piston, which slides in the body of the pump. The chamber is limited by the bottom of the body of the pump, and by the upper face of the piston.

SUMMARY OF THE INVENTION

According to an embodiment of the invention, the surface consists of the upper part of a push rod, which cooperates by its lower face with a cam connected to the power take-off.

According to an embodiment of the invention, the push rod slides in a guide, and said push rod is held in contact with the cam by a spring.

According to an embodiment of the invention, the fow regulating system consists of a stationary throttle, which is associated with an adjustable pressure limiter equipped with a control.

According to an embodiment of the invention, the flow regulating system consists of a variable throttle equipped with a control and associated with a pressure limiter.

According to an embodiment of the invention, the flow regulating system consists of a proportional distributor equipped with a control and associated with a pressure limiter.

According to an embodiment of the invention, the flow regulating system consists of a distributor equipped with a control, and associated with a pressure limiter.

The variable flow pump according to the invention thus exhibits the advantage of not requiring a mechanical connection between the piston and the power take-off. Because of this, it can easily be adapted to an electric control, because the interface problems are avoided. Moreover, the unit exhibits a very good efficiency, and the simplicity of the device results in a low cost.

BRIEF DESCRIPTION OF THE DRAWINGS

Other characteristics and advantages of this invention will come out from the following description of the embodiments given by way of example with reference to the accompanying drawings in which.

DETAILED DESCRIPTION OF THE PREFERRED EMBODIMENTS

Figure 1:
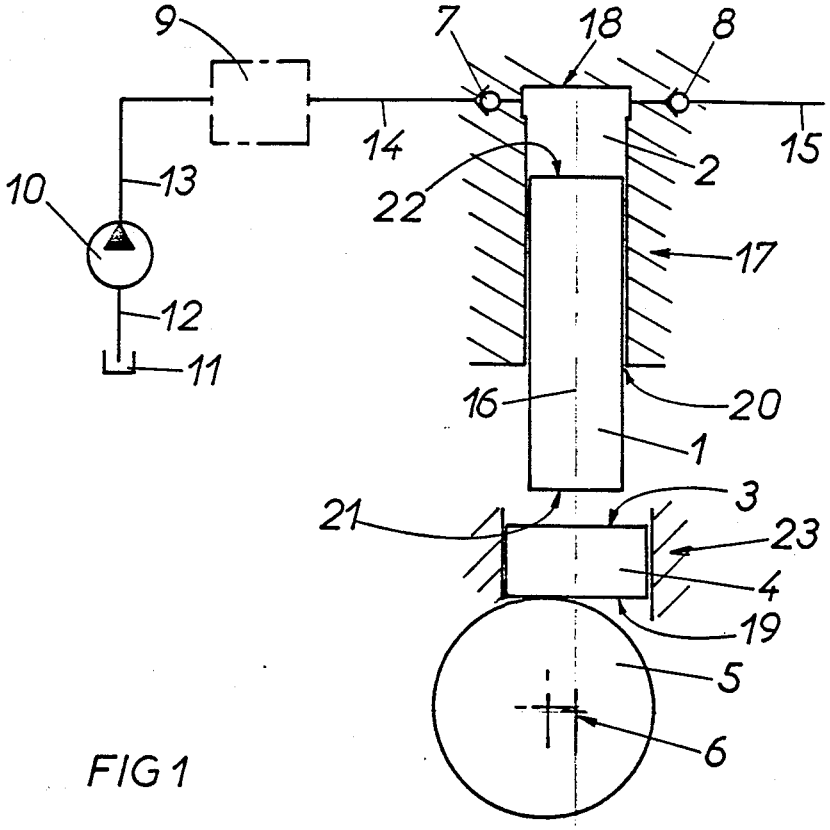
FIG. 1 is a diagrammatic view with a partial section of the variable flow pump according to the invention.

The entire variable flow pump device according to the invention is represented diagrammatically in FIG. 1. This unit comprises the variable flow pump which consists of a piston 1, which slides in a bore 20 made in body 17 of the pump. Piston 1 cooperates with a surface 3 which is driven in a constant displacement reciprocating movement. This surface 3 is connected to the power take-off. Piston 1 is free of any continuous connection with this surface 3.

Chamber 2 is directly varied by the movement of piston 1 in bore 20. Chamber 2 is limited by bottom 18 of pump body 17 and by upper face 22 of piston 1.

Lower face 21 of piston 1 cooperates with surface 3, which belongs to a push rod 4. This push rod 4 slides freely in a guide 23. Lower face 19 of push rod 4 is associated with a cam 5 which is connected to the power take-off embodied by a shaft 6.

Chamber 2 is provided with a feed including a clack valve 7 and with a delivery having a valve 8; chamber 2 being associated with a flow regulating system 9 placed upstream from clack valve 7.

The feed circuit comprises a tank 11 in which a booster pump 10 sucks through a duct 12. This booster pump 10 delivers into a duct 13, which feeds flow regulating system 9. The pressure prevailing in duct 13 is called feed pressure $P_{13}$. Flow regulating system 9 directly feeds a booster duct 14 in which booster pressure $P_{14}$ prevails. Booster duct 14 thus connects flow regulating system 9 with feed clack valve 7. Delivery clack valve 8 is directly connected to a delivery duct 15 connected to the use.

$P_2$ is the pressure which prevails in chamber 2 of the pump, while the various flows are identified: $Q_{13}$ for the feed flow which prevalls in duct 13, $Q_{14}$ for the booster flow which prevails in duct 14, $Q_{15}$ the delivery flow which prevails in duct 15.

It should be noted in the case of FIG. 1 that the movement of cam 5 depends on the offsetting between this cam 5 and the axis of shaft 6, which goes through axis 16 of piston 1 of the pump.

The variable flow pump according to the invention thus comprises a surface 3, which is driven in a reciprocating movement obtained by cam 5. It should be noted that this reciprocating movement can be obtained by any other means, and that the movement of surface 3 is constant regardless of the capacity desired for the pump. The maximum amplitude of this movement of surface 3 defines a stroke $C_3$.

When surface 3, during the operating cycle, moves away from bore 20, piston 1 is pushed by the liquid arriving from booster pump 10 through feed clack valve 7. Feed flow $Q_{13}$ is fixed by flow regulating system 9, which will be described later. The amount of liquid introduced by means of flow regulating system 9 makes it possible for piston 1 to make a stroke $C_1$ between 0 and stroke $C_3$ of surface 3. Continuing the operating cycle, the movement of surface 3 reverses, and this surface 3 thus comes in contact with lower face 21 of piston 1. It should be noted that at the point of contact, an arrangement intended to limit impact can be provided. This arrangement is not described because it makes use of means known to a man of the art. Surface 3, before coming in contact with lower face 21 of piston 1, makes a dead stroke $C_m$ which is equal to the difference between $C_3$ and $C_1$, i.e., dead stroke $C_m$ is between 0 and $C_3$. The stroke of piston 1 is then equal to the difference between $C_3$ and $C_m$, i.e., value $C_1$. The product of stroke $C_1$ of piston 1 times the surface area of said piston 1 defines the amount of liquid delivered by piston through delivery clack valve 8. This product is the capacity of the pump at this given moment, and it is a function of the value regulated by flow regulating system 9.

Figure 2:
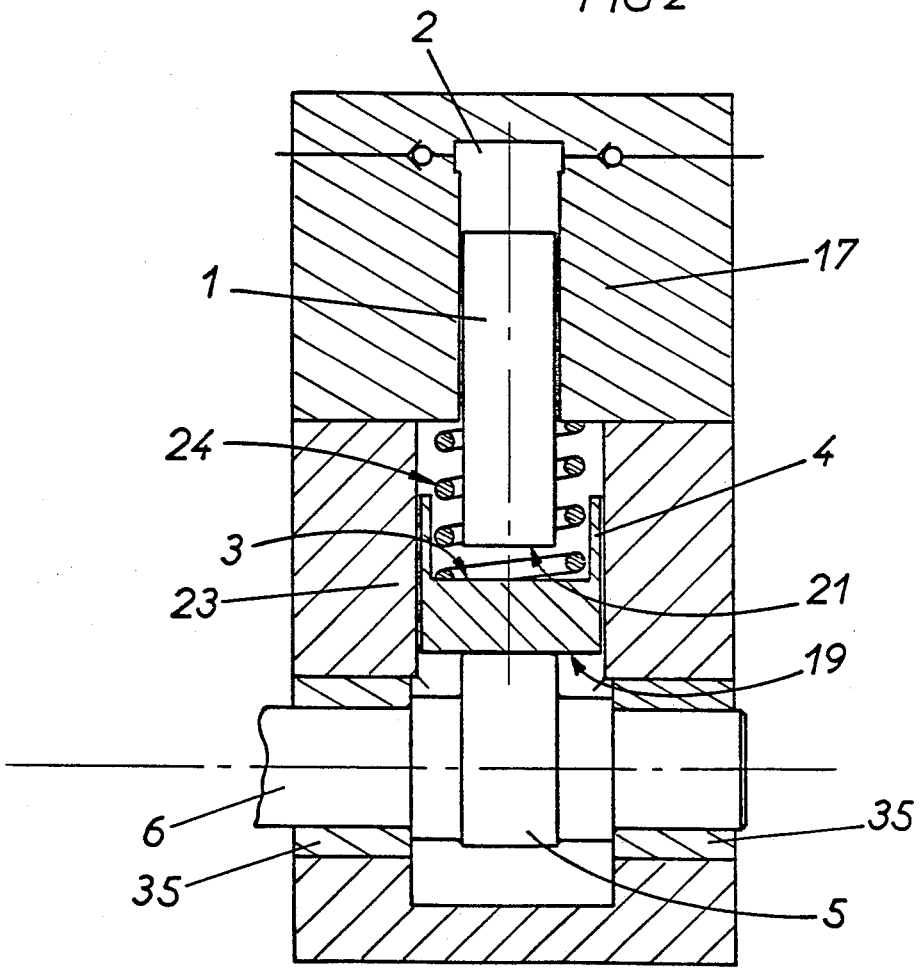
FIG. 2 is a section of an embodiment of the pump of FIG. 1.

FIG. 2 shows an embodiment of the variable flow pump according to the invention. In this embodiment, shaft 6 which carries cam 5 is supported directly by two bearings 35 mounted in guide 23 of push rod 4. A spring 24 is mounted between surface 3 of push rod 4 and the lower part of body 17 of the pump.

Figure 3:
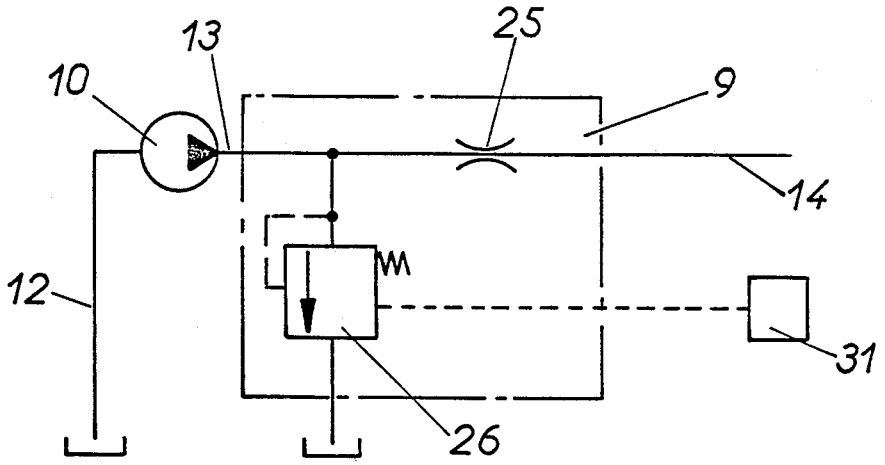
FIG. 3 is a diagrammatic view of the regulating and control elements of the pump of FIG. 1.

A first embodiment of flow regulating system 9 is represented in FIG. 3. Flow regulating system 9 comprises a stationary throttle 25 mounted on duct 13 and feeding duct 14. An adjustable pressure limiter 26 is mounted as a bypass upstream from stationary throttle 25, and it is controlled by a control 31 between open and closed positions. This first embodiment makes it possible to regulate the capacity of chamber 2 by regulating feed pressure $P_{13}$ which is estalished in duct 13 by controlling the position of pressure limiter 26 via control 31.

When surface 3 begins its downward travel, the flow going through stationary throttle 25 is given by the relation:

$$Q_{14} = \alpha \cdot S_{25} \cdot \frac{\sqrt{2(P_{13} - P_{14})}}{\rho}$$

with $\alpha$=contraction coefficient $S_{25}$=section of throttle 25 p=density of the fluid.

If k is called the coefficient that is equal to:

$$k = \alpha \sqrt{2/\rho}$$

Since the variable flow pump delivers only during the half of the rotation of shaft 6, delivery flow $Q_{15}$ will be:

$$Q_{15} = 0.5 \cdot S_{25} \cdot k \sqrt{(P_{13} - P_{14})}$$

with as maximum value for $Q_{15}$:

$Q_{15}$=geometric capacity·N·$\eta$ with: capacity=maximum volume of chamber 2

N=speed of shaft 6

$\eta$=volumetric efficiency of the pump

The apparent capacity has as its value $Q_{15}/N$ and the effective apparent capacity that will be called in the rest of the description effective capacity $C_e$ equals:

$$C_e = 0.5 \cdot k \cdot S_{25} \cdot \frac{\eta}{N} \cdot \sqrt{(P_{13} - P_{14})}$$

with as maximum value for the effective capacity $C_e$=capacity·$\eta$

Control 31, by acting on pressure limiter 26, makes it possible to regulate feed pressure $P_{13}$, and, as is seen, thus to regulate the capacity of the pump for a given speed.

Figure 4:
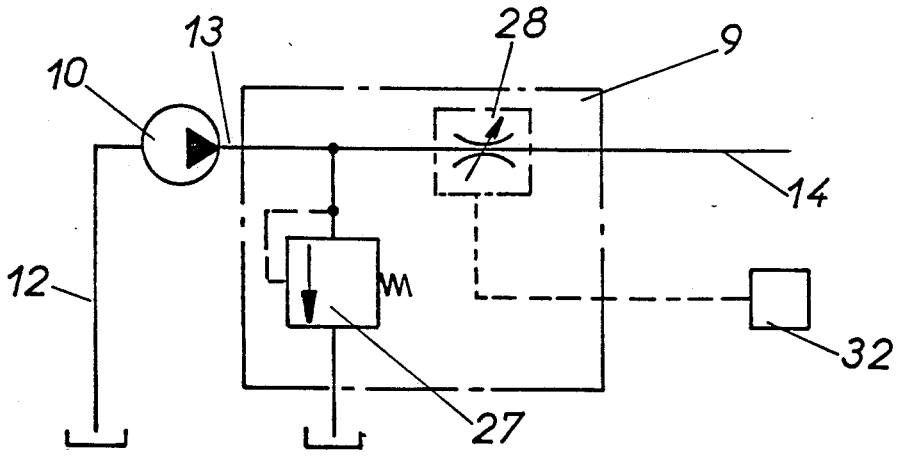
FIG. 4 is a diagrammatic view similar to FIG. 3 of another embodiment of the invention.

Another embodiment of flow regulating system 9 is represented in FIG. 4. Flow regulating system 9 comprises a variable throttle 28 mounted on duct 13 and feeding duct 14; the orifice size of this variable throttle 28 is controlled by a control 32. A pressure limiter 27 is mounted as a bypass in front of variable throttle 28.

This embodiment makes it possible to regulate the capacity of chamber 2 by regulating feed flow $Q_{13}$ with a constant feed pressure $P_{13}$.

In this case, effective capacity $C_e$ is given by the relation:

$$C_e = 0.5 \cdot k \cdot S_{28} \cdot \frac{\eta}{N} \cdot \sqrt{(P_{13} - P_{14})}$$

with $S_{28}$=section of variable throttle 28. Control 32, by acting on variable throttle 28, makes it possible to regulate the capacity of the pump for a given speed.

Figure 5:
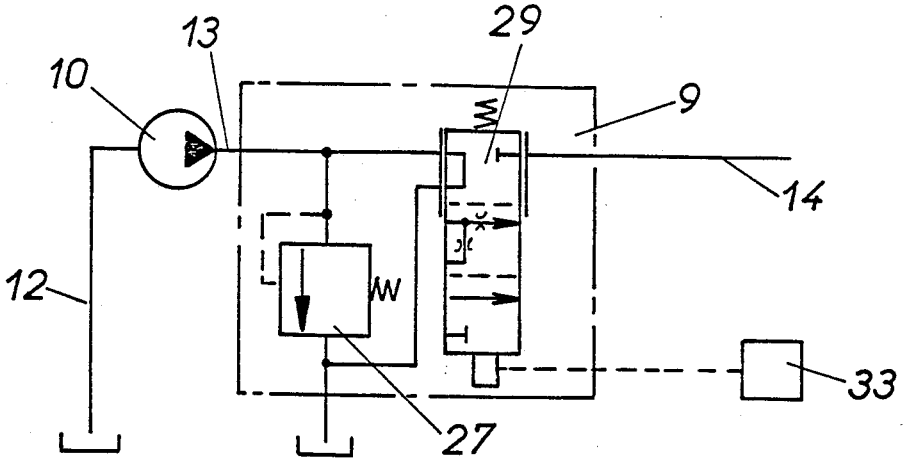
FIG. 5 is a diagrammatic view similar to FIG. 3 of another embodiment of the invention.

Another embodiment of flow regulating system 9 is represented in FIG. 5. Flow regulating system 9 comprises a proportional distributor 29 mounted on duct 13 and feeding duct 14; this proportional distributor 29 is controlled by a control 33 for movement into one of three positions. A pressure limiter 27 is mounted as a bypass upstream from proportional distributor 29. This embodiment makes it possible to regulate the capacity of chamber 2 by dividing feed flow $Q_{13}$.

Flow $Q_{13}$ of booster pump 10 is divided between booster need $Q_{14}$ and the surplus flow or escape flow $Q_f$. The proportion between booster flow $Q_{14}$ and escape flow $Q_f$ is achieved by proportional distributor 29, which is controlled by control 33. Feed pressure $P_{13}$ adjusts itself, nevertheless a pressure limiter 27 is provided for safety and to limit the pressure at the beginning or during speed changes.

In this case, effective capacity $C_e$ is given by the relation:

$$C_e = (Q_{13} - Q_f) \cdot \eta / N$$

where the value $(Q_{13} - Q_f)$ depends on control 33 and $C_e = Q_{14} \cdot \eta / N$.

If speed N is identical for booster pump 10 and for the variable flow pump, we have the relation:

$Q_{13}=C_g \cdot N$ with $C_g$=capacity of booster pump 10.

Since proportional distributor 29 has a flow division ratio R, we have:

$Q_{14}=Q_{13} \cdot R$ therefore $C_e=Q_{13} \cdot R \cdot \eta/N$ where $C_e=C_g \cdot R \cdot \eta$ Regulation of division ration R of proportional distributor 29, by control 33, then makes it possible to set the capacity independently of the speed.

Figure 6:
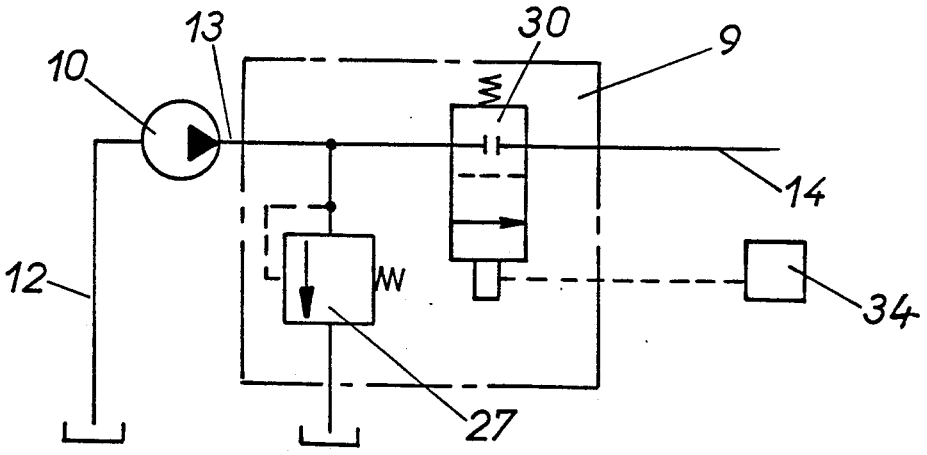
FIG. 6 is a diagrammatic view similar to FIG. 3 of another embodiment of the invention.

Another embodiment of flow regulating system 9 is represented in FIG. 6. Flow regulating system 9 comprises a distributor 30 mounted on duct 13 and feeding duct 14; this distributor 30 is controlled to move between a first position for closing duct 14 and a second position for opening duct 14 by a control 34. A pressure limiter 27 is mounted as a bypass upstream from distributor 30.

This embodiment makes it possible to regulate the capacity of chamber 2 by a sequential control.

Two-position distributor 30 is placed on booster duct 14. This distributor 30 is controlled by control 34 in a synchronous manner with the rotation of the shaft 6 of the variable flow pump. In this way it is the opening time of distributor 30 that determines booster flow $Q_{14}$. We have the relation:

$$Q_{14} = k \cdot S_{30} \cdot \frac{t}{T} \cdot \sqrt{(P_{13} - P_{14})}$$

with $S_{30}$=passage section of distributor 30 t=control time of distributor 30,

T=period of the control signal of 34.

Since the variable flow pump delivers only during half of its rotation, delivery flow $Q_{15}$ will be:

$$Q_{15} = k \cdot S_{30} \cdot \frac{t}{0.5 \cdot T} \cdot \eta \cdot \sqrt{(P_{13} - P_{14})}$$

where the effective capacity:

$$C_e = k \cdot S_{30} \cdot \frac{t}{0.5 \cdot T} \cdot \frac{\eta}{N} \cdot \sqrt{(P_{13} - P_{14})}$$

Since period T in seconds is indeed speed N in revolutions per second by the relation:

$$T = \frac{1}{N}$$

We have the effective capacity which is given by the relation $$C_e = 2 \cdot k \cdot S_{30} \cdot t \cdot \eta \sqrt{(P_{13} - P_{14})}$$

Regulation of time T for control 34 therefore makes it possible to set the capacity independently of the speed.

The various controls 31, 32, 33 and 34 make it possible to produce a control signal by mechanical or electrical fluid. This signal maintains the capacity at the desired value as a function of outside parameters, such as pressure, flow, power or any other.

We claim:

1. A variable flow pump comprising means defining a chamber;

a piston movable in said chamber;

means including a surface for reciprocating said piston with a constant displacement to vary the size of said chamber, said reciprocating means being free of any continuous mechanical connection with said piston;

means including a check valve for feeding fuel to be pumped to said chamber; and means including another check valve for delivering pumped fluid from said chamber, wherein said feeding means includes booster pump means for pressurizing fluid being fed to said chamber and pressure regulating means fluidically positioned in a duct between said booster pump means and said chamber for regulating the pressure of fluid reaching said chamber, said pressure regulating means comprising:

(a) distributor valve means movable between a first position for closing said duct and a second position for opening said duct, (b) a pressure limiter in said duct between said booster pump and said distributor valve means, and (c) control means for variably controlling a control time of said distributor valve means for movement between said first and second positions for each rotation of said reciprocating means, whereby the flow of fluid through said duct is controlled by the time said distributer valve means is in said second, open position.

2. The variable flow pump of claim 1 wherein said chamber is defined in part by an upper face of said piston.

3. Variable flow pump according to claim 1 wherein the surface is the upper part of a push rod having a lower face engaging with a cam.

4. Variable flow pump according to claim 3, wherein the push rod slides in a guide, including a spring for maintaining the push rod in contact with the cam.

* * * * *